United States Patent [19]

Meinke et al.

[11] 3,946,464

[45] Mar. 30, 1976

[54] DEVICES FOR HANDLING UNSPUN FIBERS

[75] Inventors: Hans Meinke; Fritz Schumann, both of Ingolstadt, Germany

[73] Assignee: Schubert & Salzer Maschinenfabrik Aktiengesellschaft, Ingolstadt, Germany

[22] Filed: Nov. 11, 1974

[21] Appl. No.: 522,699

Related U.S. Application Data

[60] Division of Ser. No. 363,181, May 22, 1973, abandoned, which is a continuation of Ser. No. 240,836, April 3, 1972, abandoned, which is a continuation of Ser. No. 17,497, March 9, 1970, abandoned.

[30] Foreign Application Priority Data

Mar. 12, 1969 Germany ..... 1912452

[52] U.S. Cl. ..... 19/150; 19/106 R

[51] Int. Cl.[2] ..... D01G 15/46

[58] Field of Search ..... 19/150, 106 R, 244

[56] References Cited

UNITED STATES PATENTS

| | | | |
|---|---|---|---|
| 267,513 | 11/1882 | Gessner | 19/106 R X |
| 2,896,269 | 7/1959 | Gardella et al. | 19/244 X |
| 3,003,195 | 10/1961 | Varga | 19/106 R X |
| 3,345,700 | 10/1967 | Kalwaites | 19/150 |
| 3,481,004 | 12/1969 | Wright et al. | 19/150 |

FOREIGN PATENTS OR APPLICATIONS

| | | | |
|---|---|---|---|
| 537,366 | 6/1941 | United Kingdom | 19/150 |
| 581,851 | 10/1946 | United Kingdom | 19/150 |

*Primary Examiner*—Dorsey Newton
*Attorney, Agent, or Firm*—Bailey & Dority

[57] ABSTRACT

A device for removing and collecting together a fiber web emerging from a card or the like comprises power driven transport means placed immediately downstream in the direction of travel of the web from the delivery device, and constituting a transport surface crossing the plane of the fiber web and adapted to produce a transport movement of the fiber web material emerging from the delivery device across the width of the web toward the center forming a sliver.

2 Claims, 9 Drawing Figures

DEVICES FOR HANDLING UNSPUN FIBERS

This is a division of application Ser. No. 363,181 filed May 22, 1973, entitled DEVICES FOR HANDLING UNSPUN FIBERS now abandoned, which was a continuation of application of Ser. No. 240,836, filed Apr. 3, 1972, for DEVICES FOR HANDLING UNSPUN FIBERS, now abandoned, which was a continuation of application Ser. No. 017,497, filed Mar. 9, 1970, now abandoned.

The prior art includes U.S. Letters Patent No. 267,513 which describes a means for feeding wool from one card to another wherein the fleece passes from a doffer over a roll, falling onto two horizontal belts, theoretically forming a batt therebetween for lapping upon the feed mechanism of another card. U.S. Letters Patent No. 3,481,004 illustrates the use of a re-directing roll to deposit a web on a single horizontal belt. However, the web in such an arrangement would tend to lap up on the upper delivery roll, and would not be evenly distributed on the belt producing loose fibers at the open end of nip unfit for delivery to a sliver can. U.S. Letters Patent No. 3,345,700 illustrates a single narrow V-belt arrangement moving within the nip of the delivery rolls forming a restrained cavity for pulling away fibers from the leading edge of the web.

The present invention, however, contemplates gathering the web delivered from a pair of superposed delivery rollers from both edges and drawing it through a sliver discharge passage formed between pulley rollers carrying oppositely moving belts prior to drawing the silver through a trumpet preparatory to depositing the sliver in a can. No prior patent utilizes a belt surface extending entirely across the delivery side of the nip in a plane tangential to both delivery rollers so that the belt is outside the nip for transporting and guiding the web in a substantially tension free state. Therefore, there is no uncontrolled web path subjected to air resistance and friction permitting higher production speeds with minimized sliver variations.

The present invention relates to the handling of unspun fibers, and more particularly to apparatus for removing and collecting a fiber web leaving the delivery means of a card, delivering such a web to form a sliver.

In the production of yarn from staple fibers it is necessary to convert the fibers which have been condensed into web into a fiber sliver for further processing. Such a conversion of a fiber web with a considerable breadth into a narrow fiber sliver can be carried out on a flat or roller card in such a manner that the fiber web emerging from the card is collected by means of a sliver-receiving funnel to a sliver and supplied via calender rollers to a sliver-storing device.

The substantial increase which has taken place in the output of such machines makes it necessary to collect together the fiber web emerging at a high speed from the machine, at the same high speed. The greater the speed of the material, the greater is the tensioning draft which is necessary for such a rapid transport and such a great tensioning draft is extremely disadvantageous as regards sliver quality. The web tends to build up in front of the sliver funnel and to tear at the edges. Such drafts due to transport result from complete lack of control of the fiber between the delivery roller nips and the sliver forming device. If the tensioning draft necessary for a particular transport speed exceeds a limit value, the web which is to be made into a sliver breaks so that there are variations in the sliver count and breakages in it. Something which is a particularly noticeable feature observed in the case of a card web, irrespective of whether the collection together occurs directly after the doffer knife or a roller draw-off device, or, alternatively, only after running through a pair of crushing rollers or two web-guiding rollers. A certain transport speed cannot be exceeded even if the machine is in a position to provide a higher speed of production.

In order to facilitate transport and collection together of the web, various additional forms of apparatus have heretofore been proposed. In accordance with these proposals the guiding of the web is promoted by an air current (German patent specification No. 428,236) or by transport belts which run in the direction of the web (see French patent specification No. 862,993) or also perpendicularly to it (German patent specification No. 81,849). There has also been a proposal to use web guide plates (German patent specification No. 704,482) or rollers which laterally guide the web and press it together to provide for a satisfactory collection and transport of the fiber web even at high speeds U.S. Pat. No. 2,326,331 and U.S. Pat. No. 2,497,647. All these known devices, however, have not been able to provide a satisfactory solution to the problem of troublefree transport and simultaneous collection together of a fiber web at high speeds.

One object of the present invention is to provide a device or apparatus which is capable of receiving a broad fiber web emerging from a high output machine through a delivery device at high speed and collecting the web together to form a sliver.

The present invention consists in a device for removing and collecting together a fiber web emerging from a delivery device, comprising power driven transport means placed immediately downstream in the direction of travel of the web from the delivery device, and constituting a transport surface crossing the plane of the fiber web and adapted to produce a transport movement of the fiber web material emerging from the delivery device across the width of the web.

With such an arrangement the fiber web material is guided positively both in the transport direction and also in the direction of collection together so that there are no limits as regards speed from the transport aspect. Preferably the transport surface formed by the transport means touches the delivery roller pair of the delivery device so that the pair of output rollers are kept clean and the winding of stray fibers on them is avoided. This effect can be reinforced by arranging for the transport surface to touch the output pair of rollers of the delivery device over their entire length. In order to ensure a trouble-free removal also of fiber materials of only moderate quality, the transport surface can be arranged to touch the output pair of rollers of the delivery device over areas as opposed to lines. The collection together of the fiber web can be promoted if that part of the transport surface which forms one side of the triangular space between the pair of output rollers of the delivery device is concavely curved. The delivery device can, for example, be in the form of a pair of crushing delivery rollers, such as used on the cards for the cleaning of a fiber web.

In order to avoid sliding in a vertical direction, the transport belt can have guide grooves on its interior surface. In order to support the cleaning effect, the transport belt can be pressed by means of resiliently mounted support plates or rollers against the pair of delivery rollers.

In the case of large web width it is also possible to provide two or more transport belts. In this case the fiber web is collected together by at least two transport belts of substantially equal length traveling in opposing directions. Conveniently the transport means can include a conventional cleaning device. In order to avoid dirt, the drive and bearing arrangement of the transport means are preferably arranged above the plane of the fiber web.

Further details of the invention will be gathered from the accompanying drawings.

FIG. 1 is an elevation of a device in accordance with the present invention in connection with crushing delivery rollers at the output side of a card shown diagrammatically from the side, FIG. 2 is an elevation of a device in accordance with the invention in combination with a pair of draw-off rollers directly behind the web removal part of a card, FIGS. 3 to 6 are plans of various embodiments of the device in accordance with the invention, FIG. 7 is an elevation of further embodiments of devices in accordance with the invention, FIG. 8 is a section through a modified part of the device of FIG. 7, and FIG. 9 is a plan of a modification of the invention similar to the device shown in FIG. 4.

DESCRIPTION OF THE PREFERRED EMBODIMENT

Figure 1:
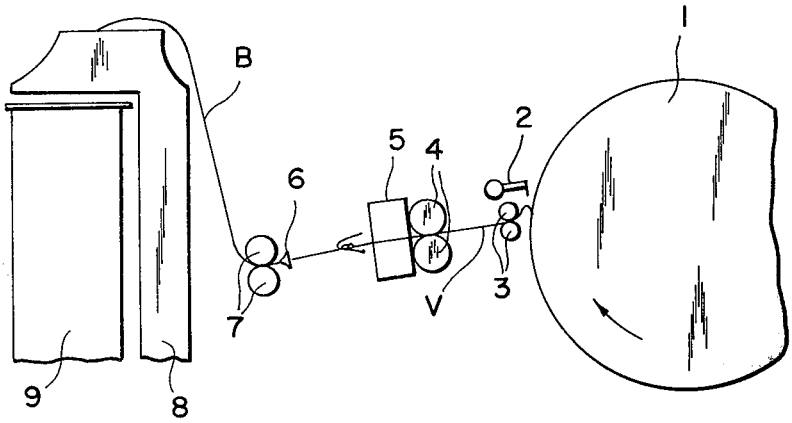
Figure 2:
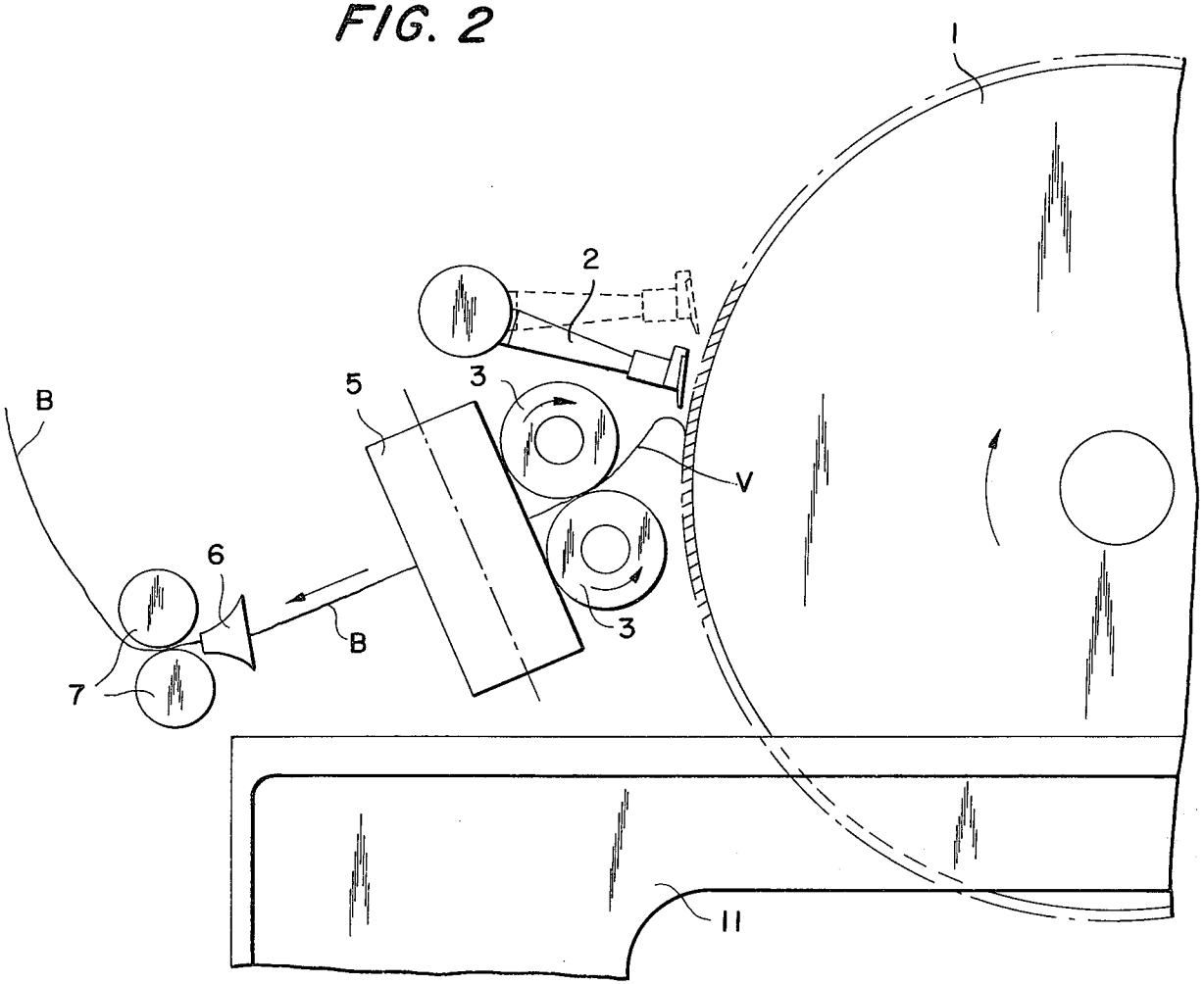

Referring now to the drawings and more particularly to FIG. 1, it will be seen that a doffing knife 2 and two draw-off delivery rollers 3 having their axes horizontal remove a carded web V from the doffing roller 1 after the web has been carded on a card 11 (FIG. 2). Normally, this carded web is collected together either directly by sliver-receiving means such as a web funnel trumpet 6 arranged ahead of the calender rollers 7 to form a sliver B and deposited by the can coiler 8 in a can 9, shown in FIG. 1, or the web is passed beforehand through a pair of crushing rollers 4. In the latter case the pair of crushing rollers 4 forms a delivery device for the horizontal web V. This pair of crushing delivery rollers 4 is followed directly by a power-drive transport device 5, which forms an upright transport surface crossing the plane of the horizontal fiber web and engaged by the fiber web to collect the fiber into a sliver. The fiber web V emerging from the pair of crushing delivery rollers runs against this transport surface and is immediately collected by the transport device 5, the web V being given a transport movement across the width of the web V. In this manner immediately after emergence from the pair of draw-off crushing delivery rollers, the web V is gathered together and is carried away as a sliver B, as shown, for example in FIG. 3. This procedure is completely positive since there is no free uncontrolled web path in which the web V is left unsupported and would have to be tensioned in order to overcome friction and/or air resistance.

Figure 3:
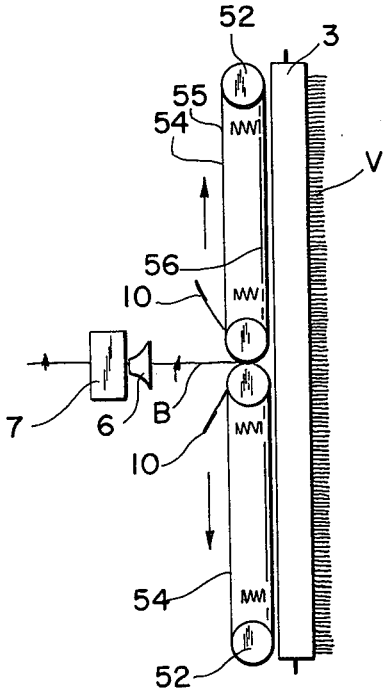

FIG. 3 shows a transport device 5 in which the carded horizontal web V is drawn together at high speed by two transport belts 54 of substantially equal length to the middle where it is drawn off at high speed as sliver B through a sliverdischarge passage formed between the end pulley rollers 52 of the adjacent ends of the two belts 54. As a delivery device use is made in this construction of a pair of draw-off delivery rollers or web-guiding rollers 3, which in accordance with FIG. 2 are arranged immediately downstream from the doffing knife. One of these rollers is superposed over the other as shown in FIG. 2. The transport belts 54 touch the pair of delivery rollers 3 over their entire length against which rollers the transport belts are pressed respectively by support plates 56 which are loaded by springs 55 as shown in FIG. 3. Owing to this contact the draw-off delivery rollers 3 are continuously cleaned and the winding of fibers on them is prevented. The web V runs into a triangular space formed by the rollers 3 and the transport belts 54, and in this space it is positively formed into a sliver by the high speed opposing movement of the two transport belts 54 and is removed through the discharge passage formed between the rollers at the adjacent ends of the belts 54. The sliver passes in a straight line to the funnel 6 immediately ahead of the calender rollers 7. The sliver-receiving funnel 6 or other device such as rollers 7 or opening in can cover is located substantially equidistantly from the axes of the two adjacent transport section end rollers 52, and the sliver B is discharged through the passage between such rollers along a course substantially perpendicularly to the plane in which the axes of such transport section end rolls are disposed, as shown in FIGS. 3, 4, 5, 6 and 10. In order to avoid fibers becoming deposited on the moving parts of the apparatus, which might lead to a splitting of the band, the transport belts 54 are provided with a cleaning device in the form of two scrapers 10.

This removal device can be arranged in many different manners to suit particular requirements. In this respect it is immaterial what type of web-removing or doffing arrangement is provided on the card. It is possible to make use of devices using rollers with card clothing, doffing knives, smooth rollers and other arrangements. For a delivery device use is best made of a pair of delivery rollers which can be arranged to perform other functions besides the transport, such as drawing or crushing. The delivery device can make use of lattice aprons or belts between which the web is guided.

A satisfactory removal of the fiber web is achieved with a takeoff or doffing device in which the transport surface touches the last pair of rollers of the delivery device over a certain area. With such an arrangement it is also possible to remove fiber material which has a high dirt content or is inclined to stick, since fibers which have adhered to the last pair of delivery rollers are reliably stripped off the rollers by the transport surface and can therefore not leave the sliver. Generally, the transport surface is perpendicular to the plane of the fiber web though it can, however, also be arranged to intersect at an angle other than 90° (see FIG. 7). As has already been described the transport surface is constituted by transport belts. The last delivery roller pair can be a roller pair having any desired function, for example, a webguiding pair of rollers or a pair of crushing rollers.

Figure 7:
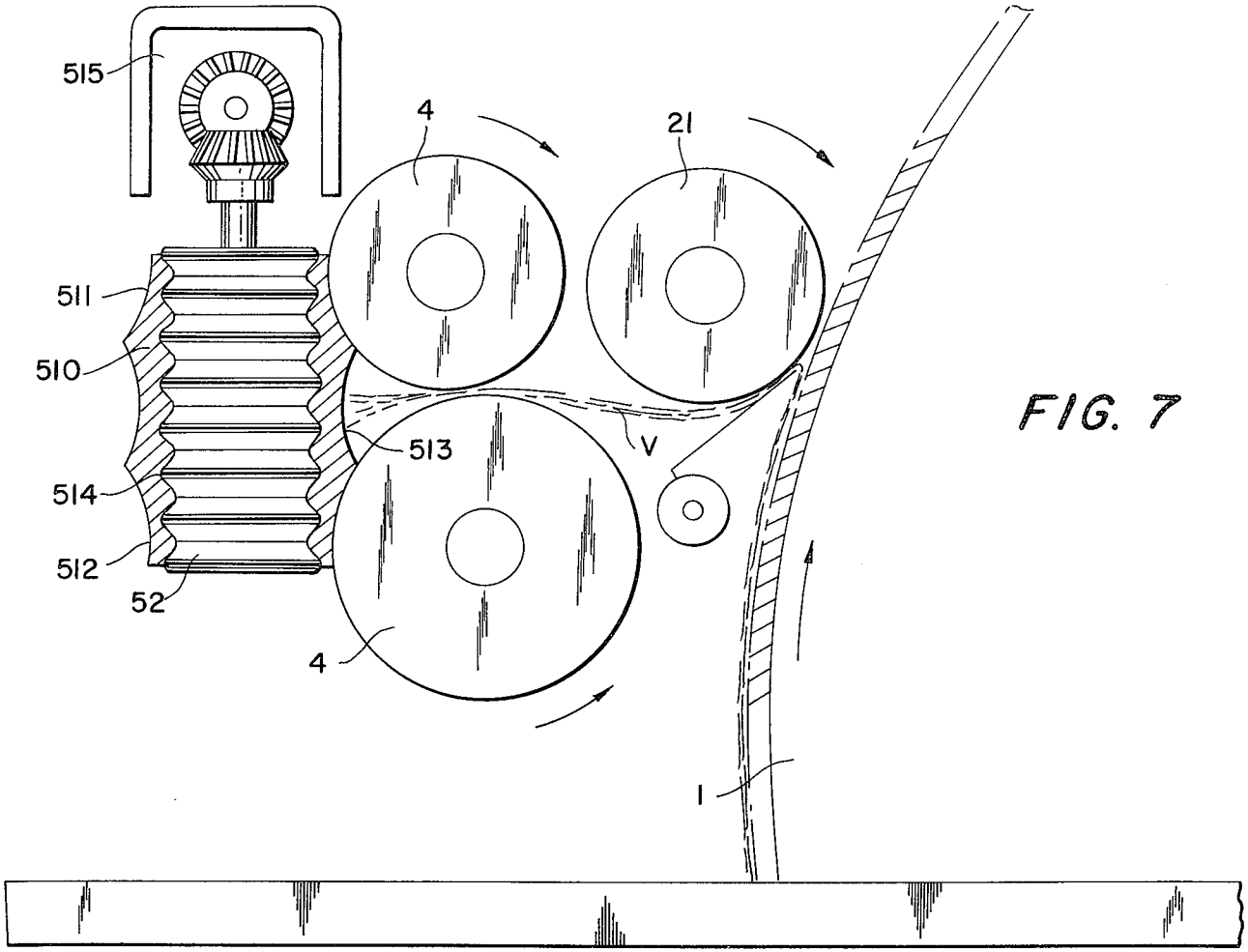

In accordance with FIG. 7 the last pair of rollers is in the form of a pair of crushing rollers 4 whose surfaces are perferably smooth in order to prevent damage to the fibers during crushing. The pair of crushing rollers 4 are supplied with a fiber web V from the doffing roller 1 of a card by a detaching roller 21 adjacent to the pair of crushing delivery rollers 4. The removal of the fiber web V from the pair of crushing rollers 4 is ensured by means of a transport surface in the form of a transport belt 510 whose edges have concave chamfered portions 511, 512. These chamfered portions, which are adapted to match the diameter of the crushing rollers 4, ensure that the transport belt 510 lies against the crushing rollers and touches them or substantially touches them over a substantial arcuate extent and over the entire length of the rollers as shown in FIG. 7 forming a large area.

Figure 8:
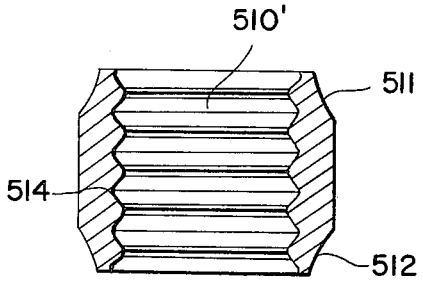

A further concave portion 513 extends over a part of the transport belt 510, which closes the space of approximately triangular cross section between the crushing delivery rollers 4 and the transport surface. This concave portion aids in collecting the fiber web to form a rounded sliver. As a transport surface which ensures that there is contact or substantial contact with the last pair of delivery rollers over a large area, it is also possible to make use of a transport belt 510' (see FIG. 8) which only has concave chamfered portions 511 and 512 at its edges.

Figure 9:
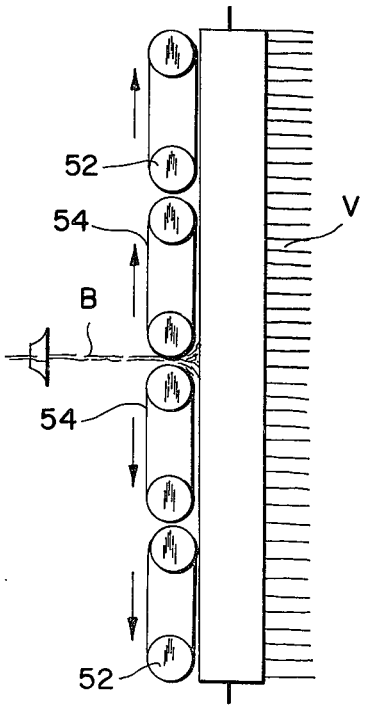

In order to prevent slipping of the transport belt 510, 510' vertically, guide grooves 514 are provided internally in the belt which are engaged by ridges of suitable shape on the rollers 52. The bevel gearing drive arrangement 515 for the transport belt 510 is preferably arranged above the plane of the fiber web V, as shown in FIG. 9. In this manner dust particles and other foreign bodies contained in the fiber material can fall out downwards without dirtying parts of the machine.

Figure 5:
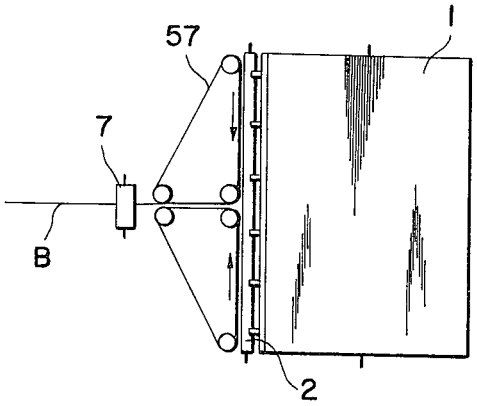
Figure 4:
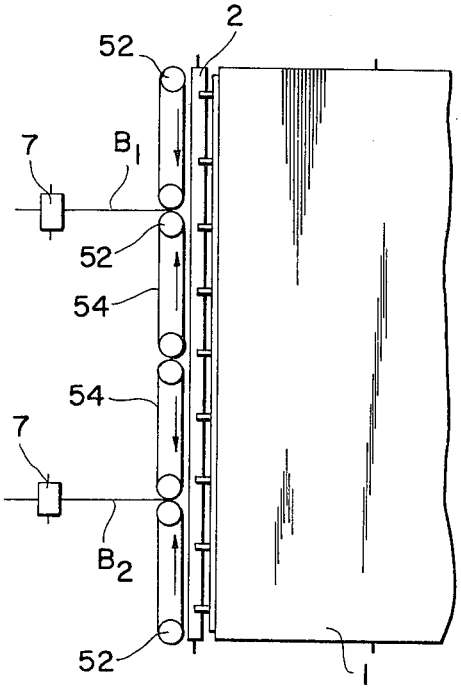
Figure 6:
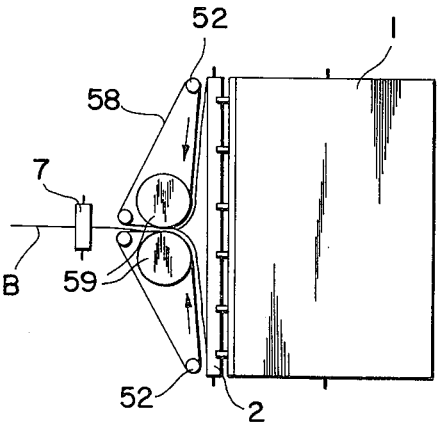

In the case of large fiber web breadths, it is also possible to divide up the transport device 5 so that the fiber web V is collected together in slivers B1 and B2 by two transport belts 54 running in opposite directions (FIG. 4), though it is also possible to collect the fiber web V in a single sliver B (see FIG. 3). In order to guide the sliver positively as far as the calender rollers 7, the transport belts 57 and 58 at the adjacent ends of the transport belt sections can be placed so that they form a sliver discharge passage extending to a location adjacent to the calender rollers 7 of sliver-receiving means and thus run parallel along this path as shown in FIGS. 5 and 6. In accordance with the thickness of the carded web and the conditions of removal, it is also possible to provide guide rollers 59 at the end of the belts as shown in FIG. 6, the distance from the delivery device possibly being made so that it can be changed in order to alter the inlet space for the carded web V in accordance with particularly requirements. A modification of the distance of the guide rollers 59 from the delivery device results in the transport belts 58 touching the delivery device, which is not visible since it is arranged below the doffing knife 2, only over part of the length of the rollers. Also removal of the carded web V can be brought about without the transport surface being in actual contact with the delivery device. This ensures that the transport surface is not worn by friction on the delivery device. Cleaning of the delivery device by the transport surface does not occur in this case. The distance between the transport surface and the delivery device should, however, not be greater than the staple length of the fibers to be doffed.

The above-described invention is intended to overcome the problem of transport and simultaneous collecting together of broad fiber webs or bands in a simple manner and at maximum delivery speeds. There is no necessity for high drafts for tensioning the material, as has been more particularly necessary for the removal of a web from crushing rollers, so that the sliver quality is improved.

What is claimed is:

1. In a carding machine having a pair of driven transverse superposed delivery rollers for receiving a web of carded fibers, in open width in a receiving side of a nip formed between the rollers in alignment with the path of web delivery, for delivery from a delivery side of said nip toward sliver take up means, the improvement comprising a web controlling and sliver forming apparatus carried between said delivery rollers and said sliver take up means including:

A. a pair of transverse belts aligned in spaced end to end relation extending substantailly entirely across said web in open width;

B. each of said belts being carried on substantially vertical axes presenting a surface extending entirely across the delivery side of said nip tangential to both rollers so that both belts are outside the nip;

C. means for supporting and driving each of said belts in opposite directions gathering said web inwardly from each edge and transporting and guiding the web to a medial portion thereof in a substantially tension free state;

D. said means for supporting and driving each of said belts including a pair of spaced aligned driven pulley rollers receiving said belts;

E. a sliver discharge passage formed between adjacent pulley rollers of each pair of pulley rollers by adjacent ends of said belts through which said gathered web is drawn as a sliver by said sliver take up means;

F. said sliver take up means including a trumpet and calender rolls positioned in alignment with said delivery rollers and said belts so that a path of said web extending to said delivery rollers and a path of said sliver being drawn through said sliver discharge passage are substantially in the same plane and substantially in the same direction;

G. pressing support means for maintaining said transverse belts in surface contact with said delivery rollers along substantially their entire length for avoiding buildup of fibers on said delivery rollers; and H. means for maintaining said belts in longitudinal alignment on said driven pulley rollers;

whereby the web is under positive control during the sliver forming operation permitting high speed carding.

2. The structure as set forth in claim 1 wherein said means for maintaining said belts in longitudinal alignment includes vertically spaced guide grooves in said pulley rollers, and wherein said pressing support means includes resilient means.

* * * * *